US010081974B2

(12) United States Patent
Gherardi

(10) Patent No.: US 10,081,974 B2
(45) Date of Patent: Sep. 25, 2018

(54) HINGE DEVICE WITH LONG RECIPROCATING STROKE OF A FRONT PANEL

(71) Applicant: C.M.I. CERNIERE MECCANICHE INDUSTRIALI S.R.L., Valsamoggia (IT)

(72) Inventor: Eros Gherardi, Bologna (IT)

(73) Assignee: C.M.I. CERNIERE MECCANICHE INDUSTRIAL S.R.L. (IT)

( * ) Notice: Subject to any disclaimer, the term of this patent is extended or adjusted under 35 U.S.C. 154(b) by 0 days.

(21) Appl. No.: 15/749,991

(22) PCT Filed: Aug. 4, 2016

(86) PCT No.: PCT/EP2016/068671
§ 371 (c)(1),
(2) Date: Feb. 2, 2018

(87) PCT Pub. No.: WO2017/021500
PCT Pub. Date: Feb. 9, 2017

(65) Prior Publication Data

US 2018/0230729 A1 Aug. 16, 2018

(30) Foreign Application Priority Data

Aug. 5, 2015 (IT) ..... UB2015A2915

(51) Int. Cl.
*E05F 1/08* (2006.01)
*E05D 7/00* (2006.01)
(Continued)

(52) U.S. Cl.
CPC ..... *E05F 1/1276* (2013.01); *A47L 15/4265* (2013.01); *E05D 3/122* (2013.01);
(Continued)

(58) Field of Classification Search
CPC ... F16F 15/03; F16F 6/00; F16F 6/005; F24C 15/02; F24C 15/023; E05F 1/1276;
(Continued)

(56) References Cited

U.S. PATENT DOCUMENTS 1,526,395 A * 2/1925 Swanson ..... E05F 3/16 16/64
1,759,474 A * 5/1930 Volquardsen ..... E05F 1/1261 16/289
(Continued)

FOREIGN PATENT DOCUMENTS

DE 3140039 A1 * 4/1983 ..... A47L 15/4261
EP 2407723 A1 1/2012
(Continued)

OTHER PUBLICATIONS

International Search Report and Written Opinion of the International Searching Authority Application No. PCT/EP2016/068671 Completed: Oct. 18, 2016; dated Oct. 28, 2016 10 pages.

*Primary Examiner* — Chuck Y Mah
(74) *Attorney, Agent, or Firm* — Ware, Freesola, Maguire & Barber LLP

(57) ABSTRACT

Hinge device (1) with long reciprocating stroke of a front panel (P) and having a first member (3) assigned to be fixed to an appliance (A) and a second member (5) assigned to be fixed to a door (D) of the appliance; the second member is pivoted to the first member by means of a hinge pin (7). A connection means (9) is assigned to be fixed to the front panel for actuating the translation thereof along the door during the rotation of the latter between its extreme closing (C) and opening (O) conditions. The hinge device includes kinematic means (11) having one end movable in the first member and an opposite end provided with a ring gear (13) centrally and rotatably pivoted to the second member or to
(Continued)

an element fixed thereto, by means of a respective first pivot pin (15).

10 Claims, 11 Drawing Sheets

(51) Int. Cl.
*E05F 1/12* (2006.01)
*E05D 3/12* (2006.01)
*A47L 15/42* (2006.01)

(52) U.S. Cl.
CPC ... *E05Y 2201/716* (2013.01); *E05Y 2201/722* (2013.01); *E05Y 2800/102* (2013.01); *E05Y 2800/45* (2013.01); *E05Y 2900/302* (2013.01); *E05Y 2900/304* (2013.01)

(58) Field of Classification Search
CPC ..... E05F 1/1292; E05F 1/1261; E05F 1/1253; E05F 3/02; E05F 3/10; E05Y 2201/41; E05Y 2201/412; E05Y 2201/414; E05Y 2201/416; E05Y 2201/40; E05Y 2201/46; E05Y 2900/30; E05Y 2900/302; E05Y 2900/304; E05Y 2900/308; E05Y 2800/102; E05Y 2800/45; E05Y 2201/716; E05Y 2201/722; E05D 11/1064; E05D 3/18; E05D 3/122; Y10T 16/5383; A47L 15/4265
See application file for complete search history.

(56) References Cited

U.S. PATENT DOCUMENTS 2,626,420 A * 1/1953 Mongin ..... E05F 1/1253 16/79
3,466,105 A * 9/1969 Guth ..... A47L 15/4261 126/340
3,820,866 A * 6/1974 Kaldenberg ..... A47L 15/4261 312/276
4,021,968 A * 5/1977 Kendall ..... E05F 1/1075 126/191
4,163,344 A * 8/1979 Scherer ..... F24C 15/023 126/191
4,872,239 A * 10/1989 Ferguson ..... E05F 1/105 16/64
5,262,762 A * 11/1993 Westover ..... B41J 5/10 341/22
6,848,759 B2 * 2/2005 Doornbos ..... E05F 1/16 16/64
7,896,972 B2 * 3/2011 Berends ..... A47L 15/0034 134/18
8,001,654 B2 * 8/2011 Tomioka ..... E05F 3/102 16/62
8,186,010 B2 * 5/2012 Tomiji ..... E05F 5/027 16/62
8,226,183 B2 * 7/2012 Kang ..... E05D 3/022 16/362
8,250,711 B1 * 8/2012 Chen ..... E05D 7/081 16/239
8,985,717 B2 * 3/2015 Marzorati ..... E05F 1/1261 16/286
2007/0283532 A1 * 12/2007 Vanini ..... E05F 1/1261 16/277
2010/0109497 A1 * 5/2010 Blersch ..... E05D 3/18 312/405
2010/0212112 A1 * 8/2010 Steurer ..... E05F 1/1261 16/286
2010/0281650 A1 * 11/2010 Kleemann ..... A47L 15/4261 16/64
2011/0146655 A1 * 6/2011 Basavalingappa Mudbasal ..... E05F 1/1261 126/194
2012/0067333 A1 * 3/2012 Mirshekari ..... E05F 1/1041 126/192
2014/0130302 A1 * 5/2014 Bettinzoli ..... E05F 1/1261 16/304

FOREIGN PATENT DOCUMENTS

WO 2011039225 A1 4/2011
WO 2014206778 A1 12/2014

* cited by examiner

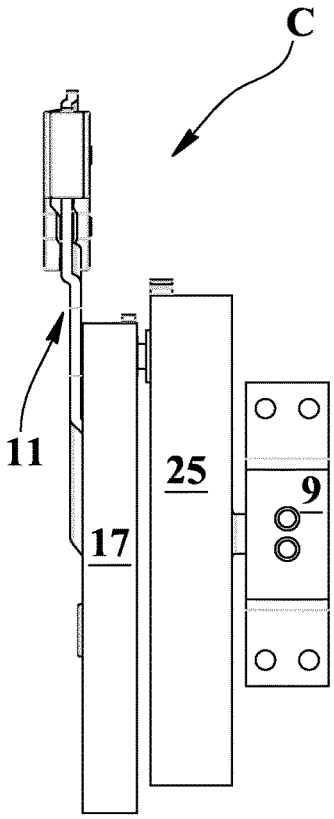
FIG.14
FIG.13
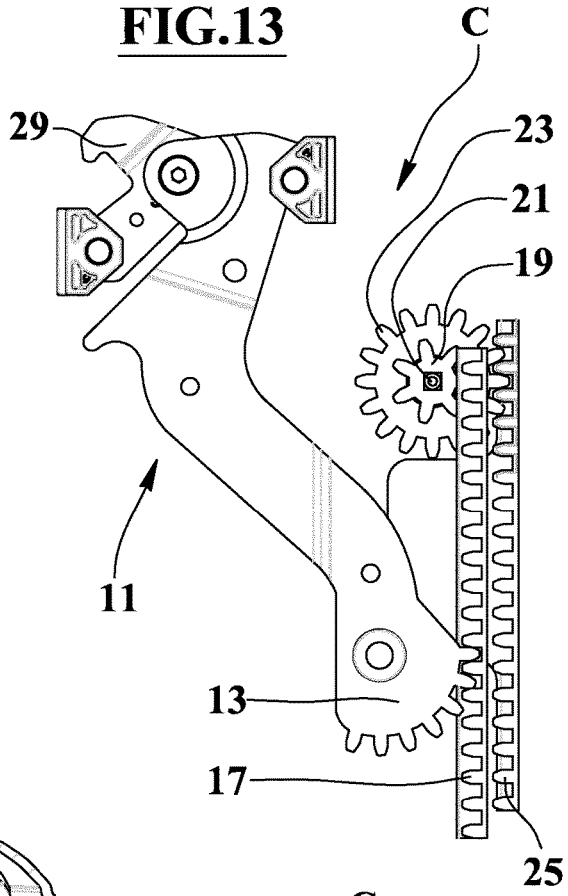
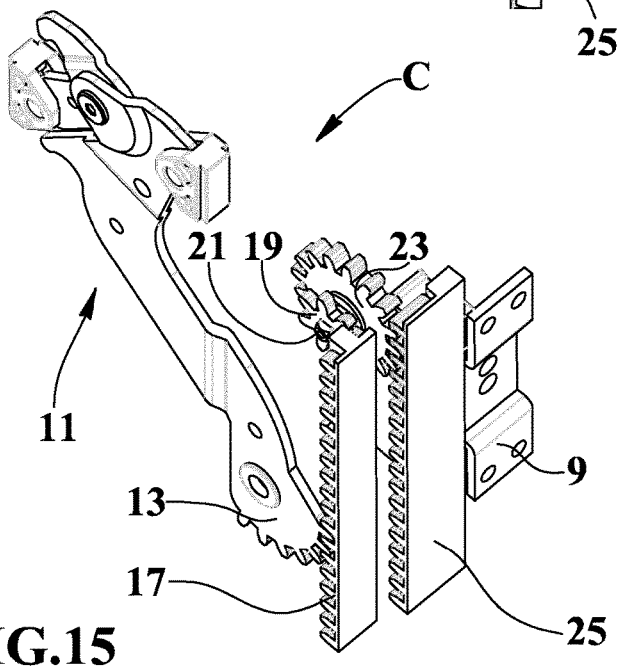
FIG.15

HINGE DEVICE WITH LONG RECIPROCATING STROKE OF A FRONT PANEL

BACKGROUND

1. Technical Field

The present invention relates to the field concerning household appliances and furniture related thereto, and relates to a hinge device with long reciprocating stroke of a front panel especially suitable for furniture and for built-in appliances, for example for a dishwasher door panel embedded in kitchen furniture.

2. Discussion of Related Art

Kitchen floor furniture can integrate a dishwasher which may have a door having a horizontal and lower rotation axis that bears a panel, generally coordinated with the doors of the furniture or equal to them. Often the panel extends below the door and, to avoid that during the opening of the door it will interfere with the kitchen toe kick boards or elements of the same dishwasher, the panel is lifted during the rotation of the door by means of a hinge selected from among known hinges of this type.

Such known hinges can be equipped with leverages or gears that convert the door rotary motion into a translation of the panel with respect to the door itself.

A drawback of such known hinges consists in that they allow an insufficient panel stroke.

Another drawback consists in the limitations of shapes and proportions caused by such known hinges.

A further drawback of the known hinges consists in that to change the panel movement and/or the transmission ratio they have to be completely redesigned and revised.

Prior document EP2407723A1 discloses a hinge device with long reciprocating stroke of a front panel and having a first member assigned to be fixed to an appliance and a second member assigned to be fixed to a door of the appliance and pivoted to the first member by means of a hinge pin; such device is also equipped with a connection means assigned to be fixed to the front panel for actuating the translation thereof along the door during the rotation of the latter between its extreme closing and opening conditions; said device further includes kinematic means having one end movable in the first member and the opposite end centrally and rotatably pivoted to the second member or to an element fixed to the latter, by means of a respective first pivot pin.

Prior documents WO2011/039225A1 and WO2014/206778A1 disclose hinge devices with reciprocating stroke of a front panel including a rack but not in association of a second rack in the same hinge and not associated with a ring gear mounted on the kinematic means.

DISCLOSURE OF INVENTION

One object of the present invention is to propose a hinge device with long reciprocating stroke of a front panel.

Another object is to propose a hinge device which allows the greatest possible freedom in the design of the front panel and of the furniture in which the appliance is embedded.

A further object is to propose a hinge device in which it is easy to change the transmission ratio or the ratio between the opening angle of the door and corresponding translation of the panel along the door.

BRIEF DESCRIPTION OF DRAWINGS

The characteristics of the invention are highlighted in the following with particular reference to the accompanying drawings in which:

FIGS. 13-15 illustrate respectively side, rear and axonometric views of only kinematic members of the device in the closed condition of FIG. 1;

BEST MODE FOR CARRYING OUT THE INVENTION

Figure 2:
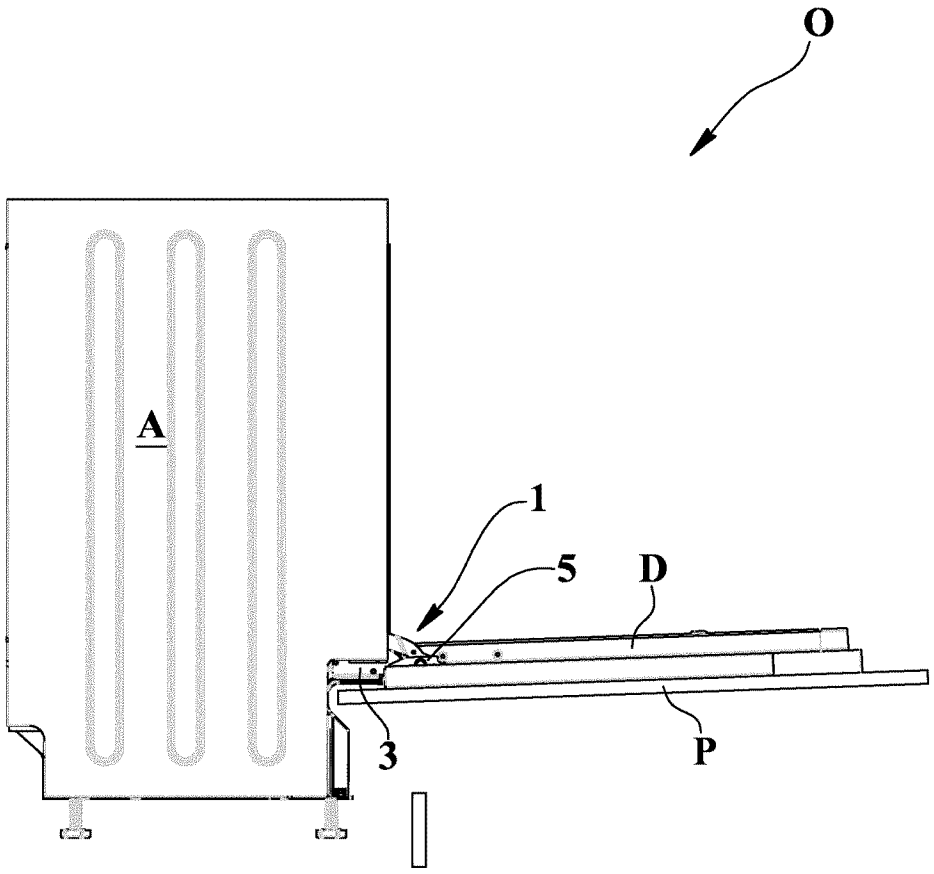
FIGS. 1 and 2 show side views of an integrated or embedded dishwasher in a furniture, provided with the hinge devices of the present invention, in respectively closed and of total opening conditions.
Figure 1:
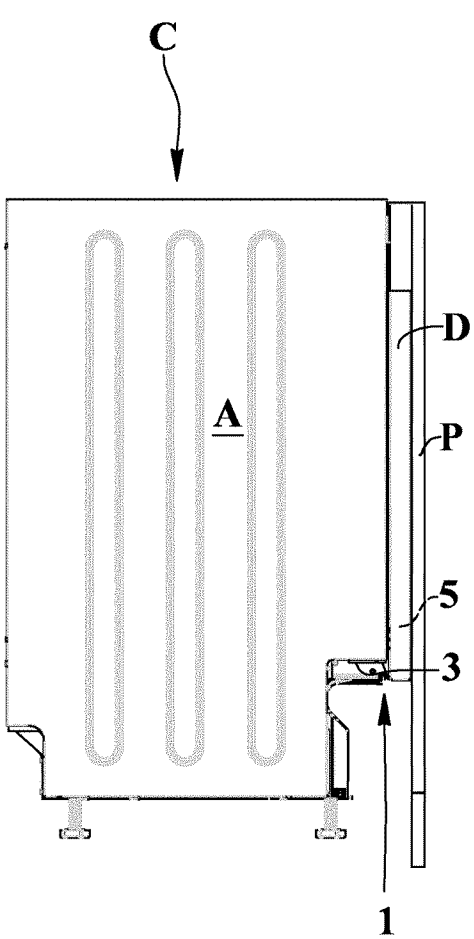
Figure 3:
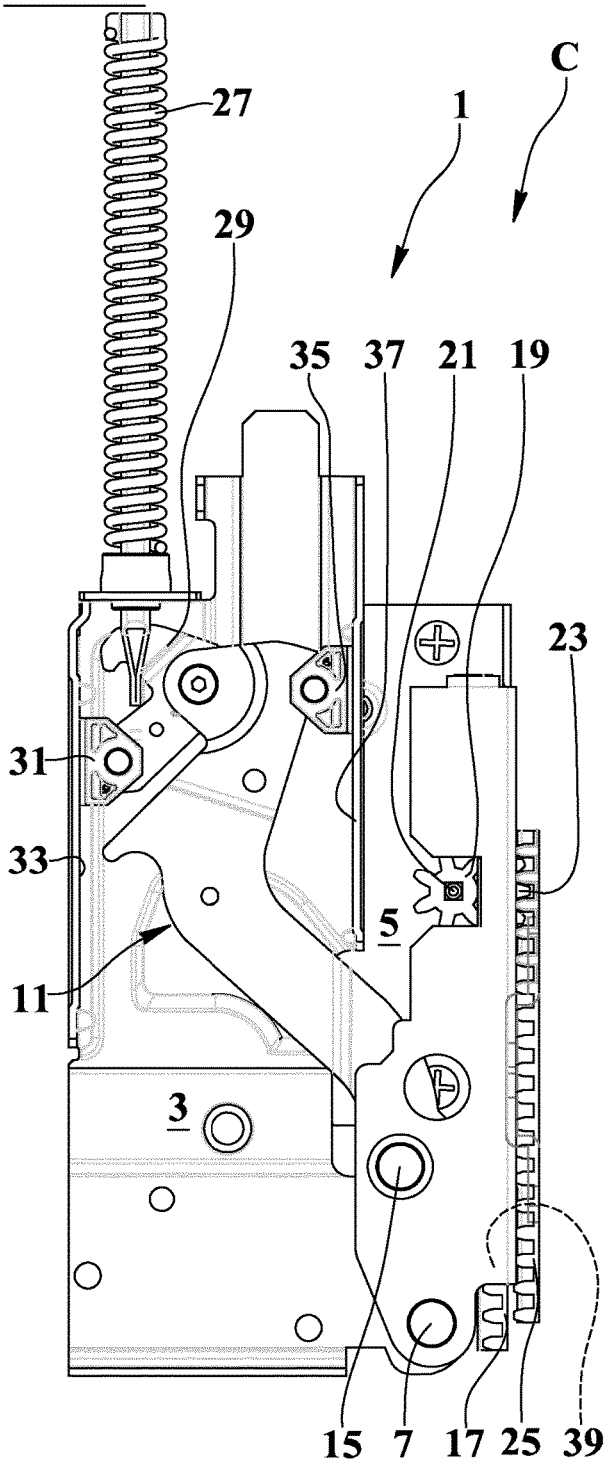
FIGS. 3-7 show respectively side, front, rear views, from below and from above of the hinge device in the closed condition of FIG. 1.
Figure 4:
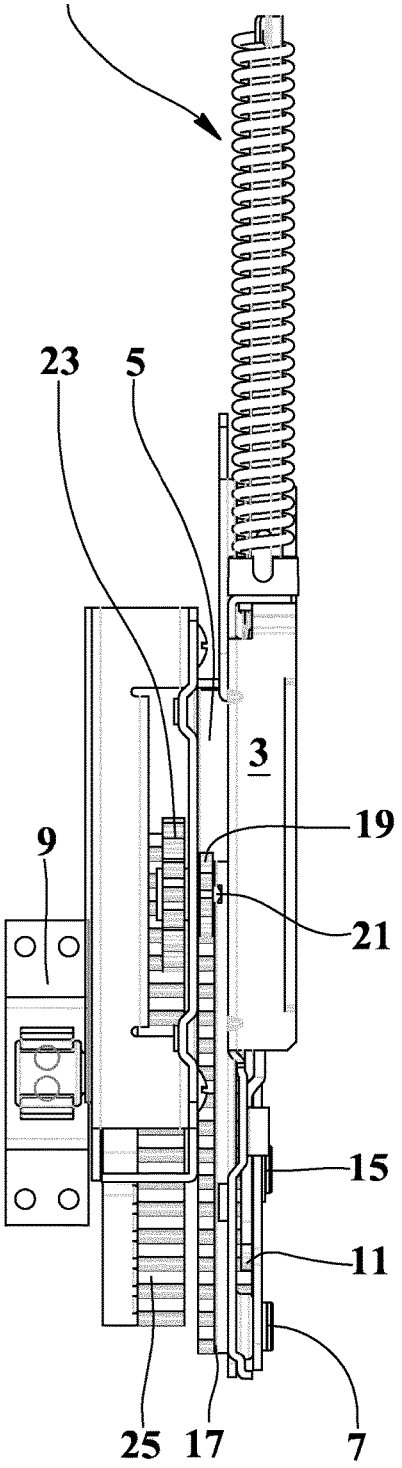
Figure 5:
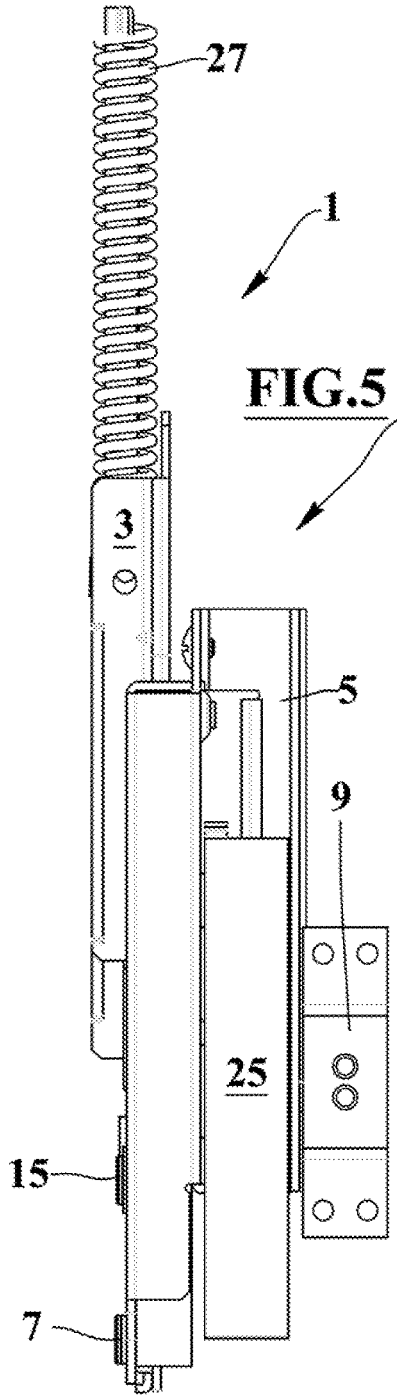
Figure 6:
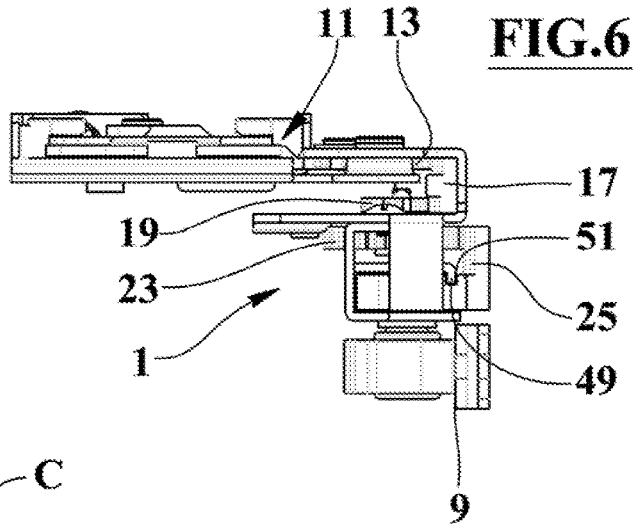
Figure 7:
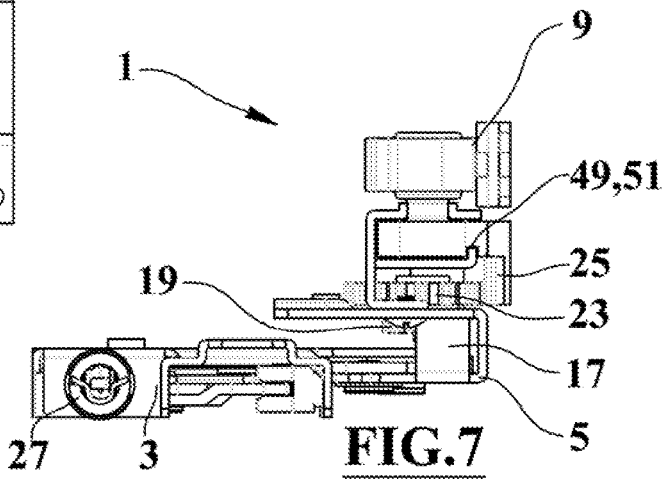
Figure 8:
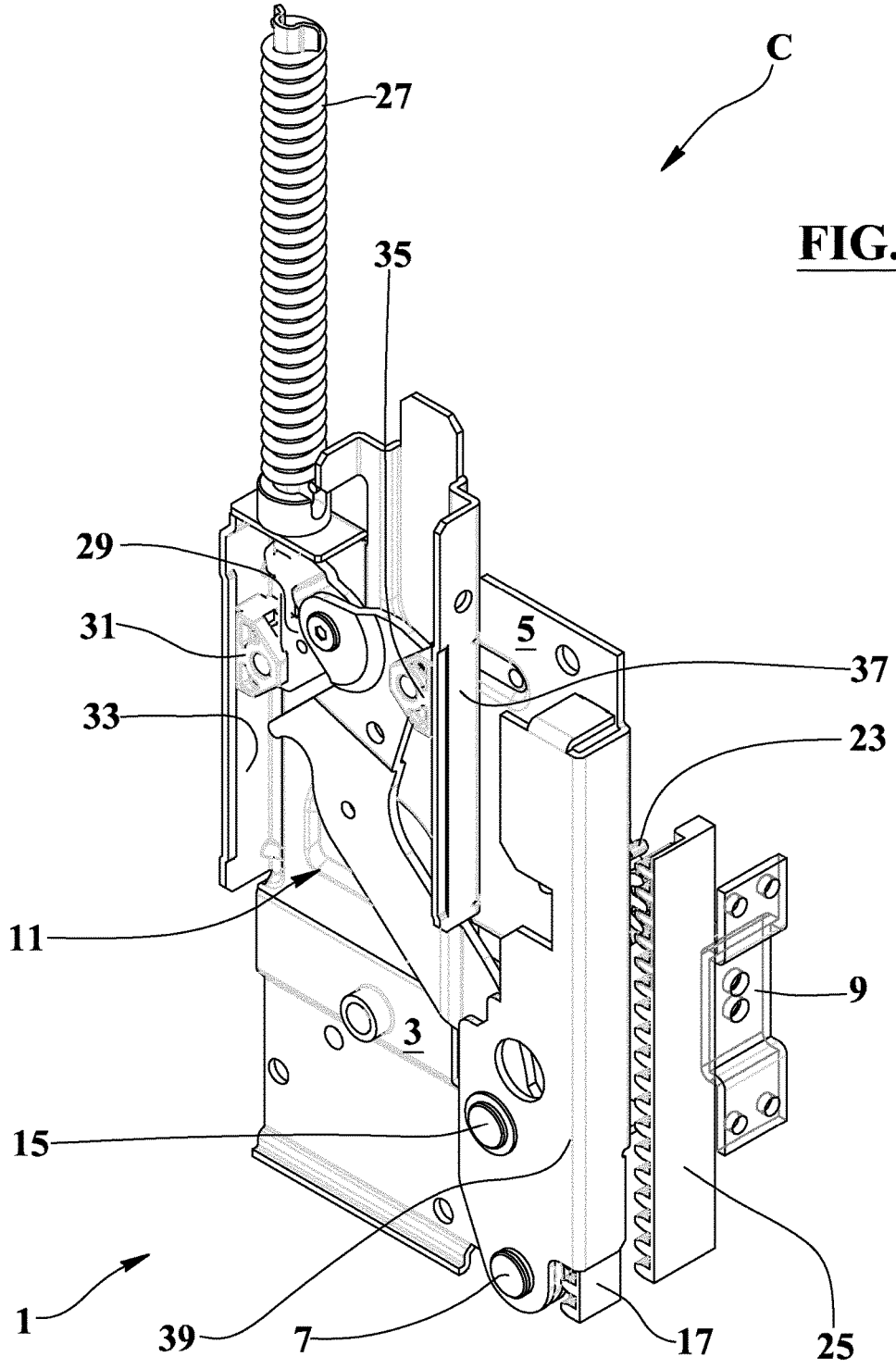
FIGS. 8 and 9 show axonometric views from respective points of view of the hinge device in the closed condition of FIG. 1.
Figure 9:
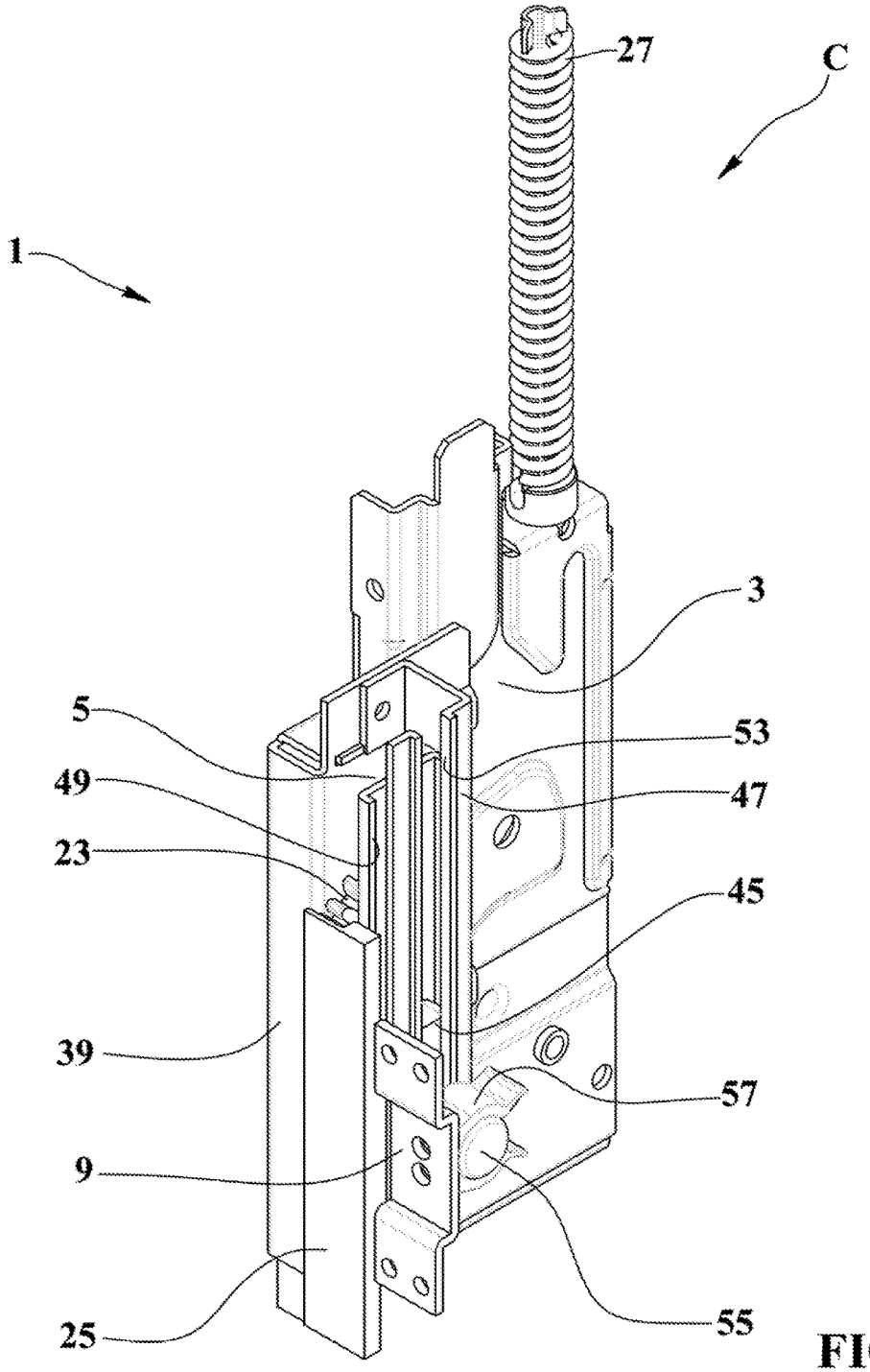
Figure 11:
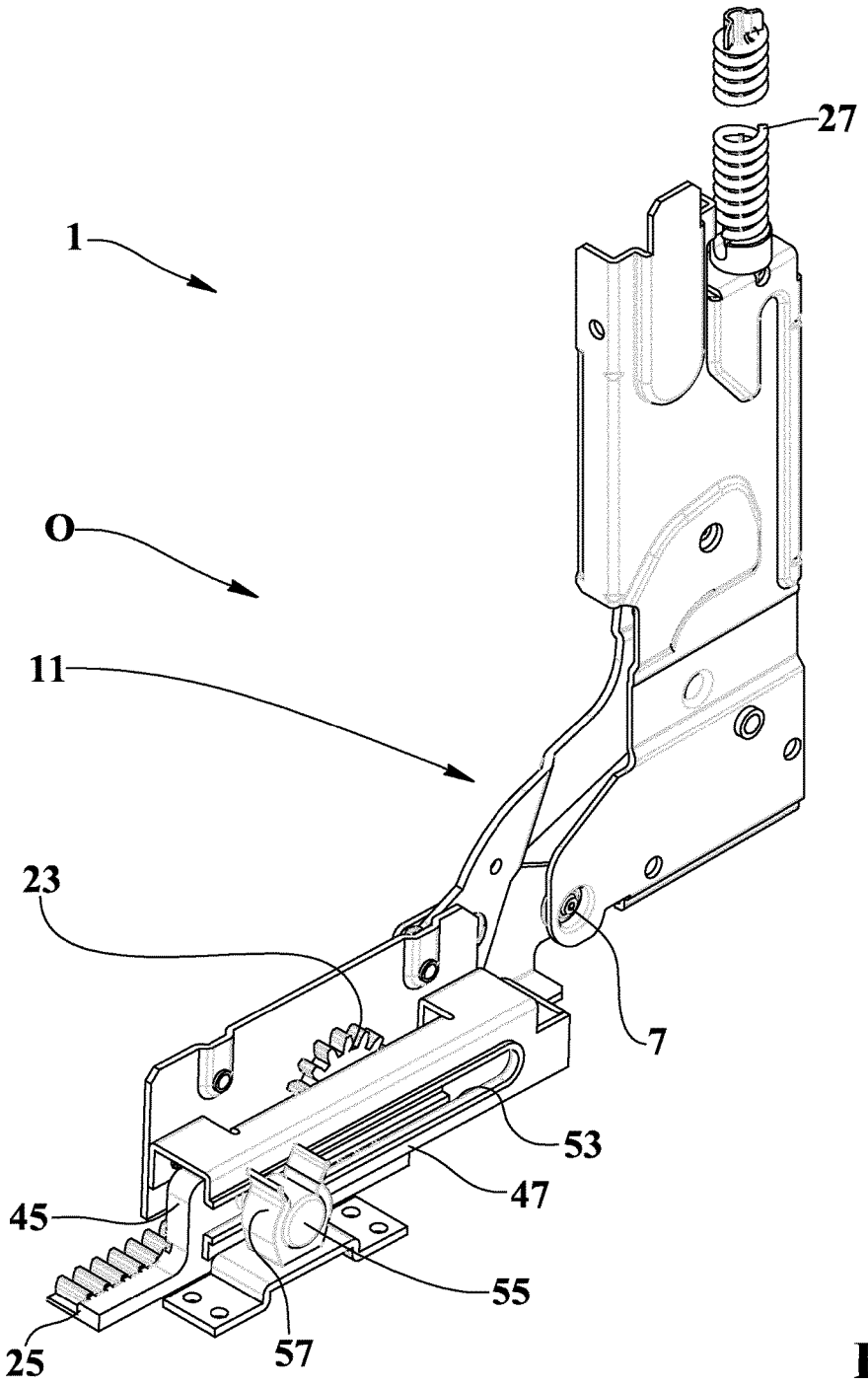
FIGS. 10 and 11 show axonometric views from respective points of view of the hinge device in the condition of total opening of FIG. 2.
Figure 10:
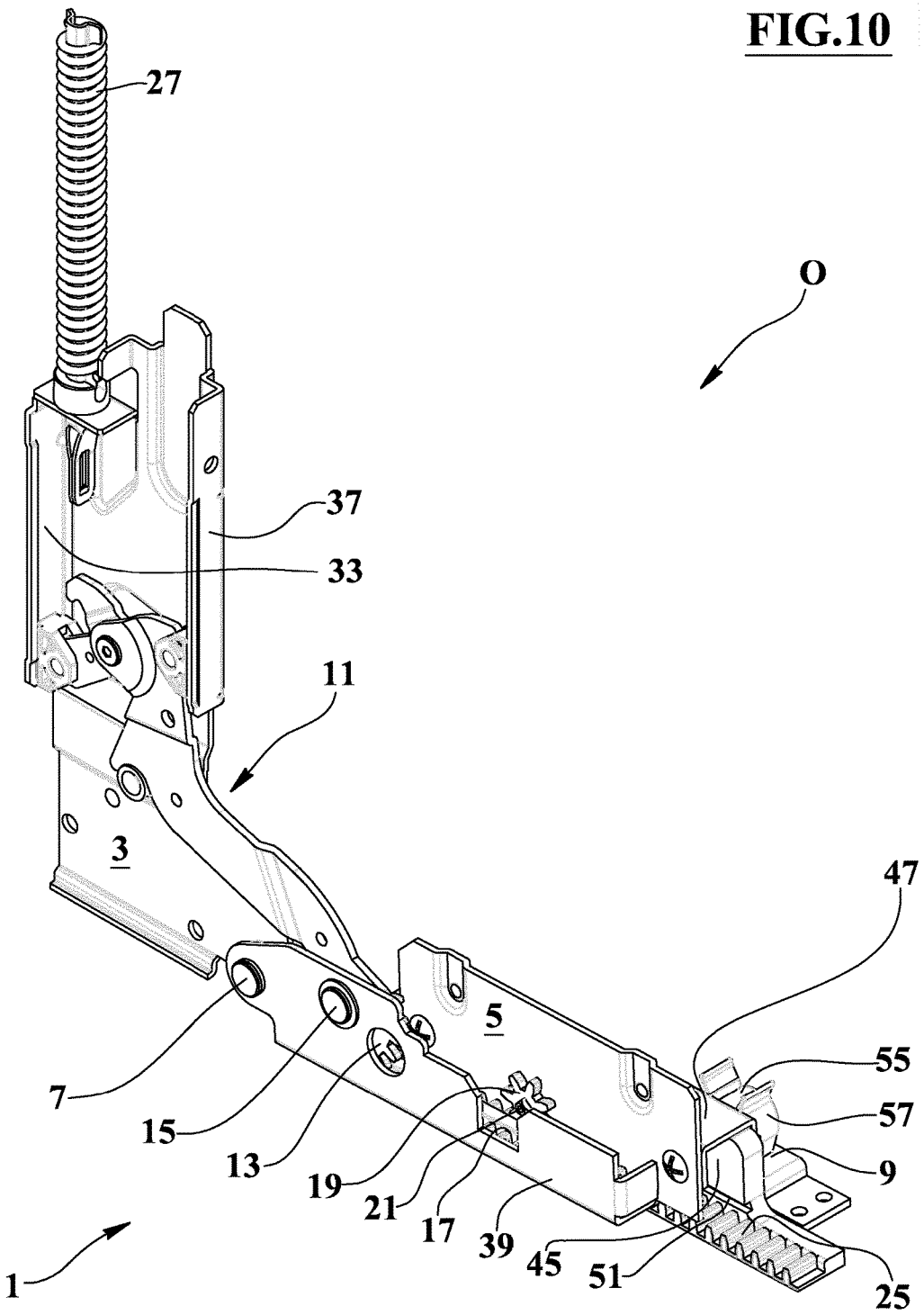
Figure 12:
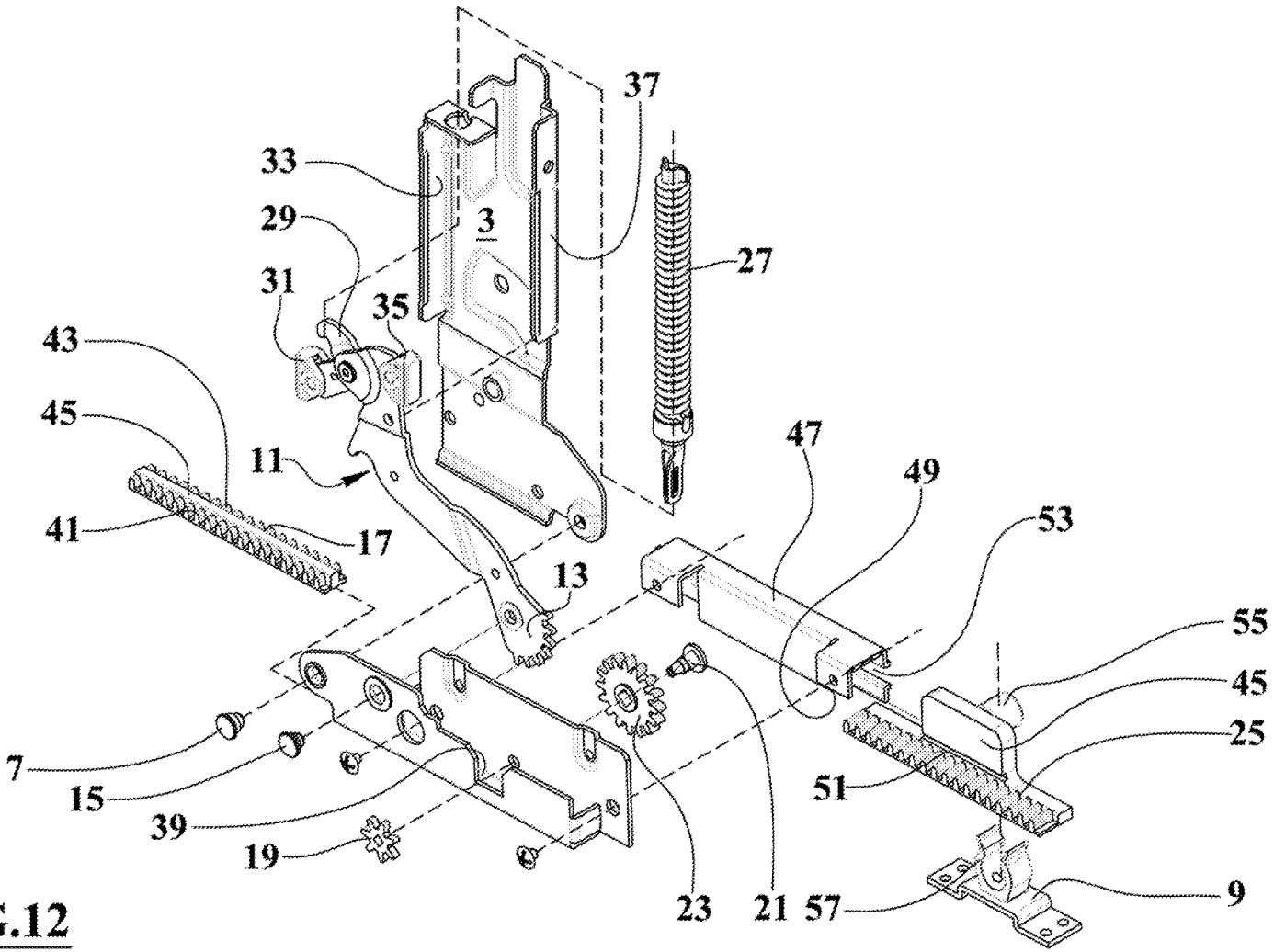
FIG. 12 illustrates an exploded view of the hinge device.
Figure 16:
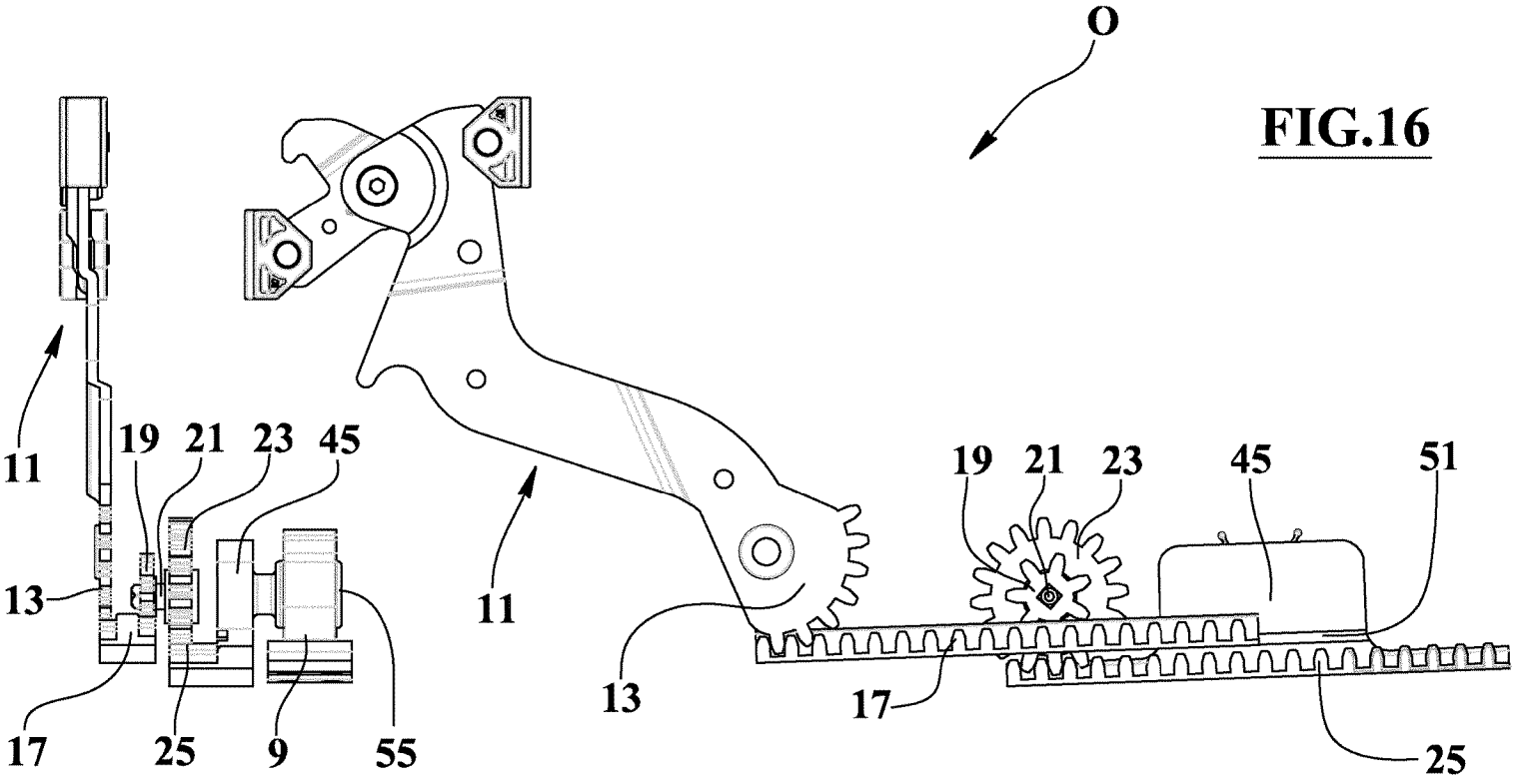
FIGS. 16-18 illustrate respectively side, rear and axonometric views of only kinematic members of the device in the condition of total opening of FIG. 2.
Figure 17:
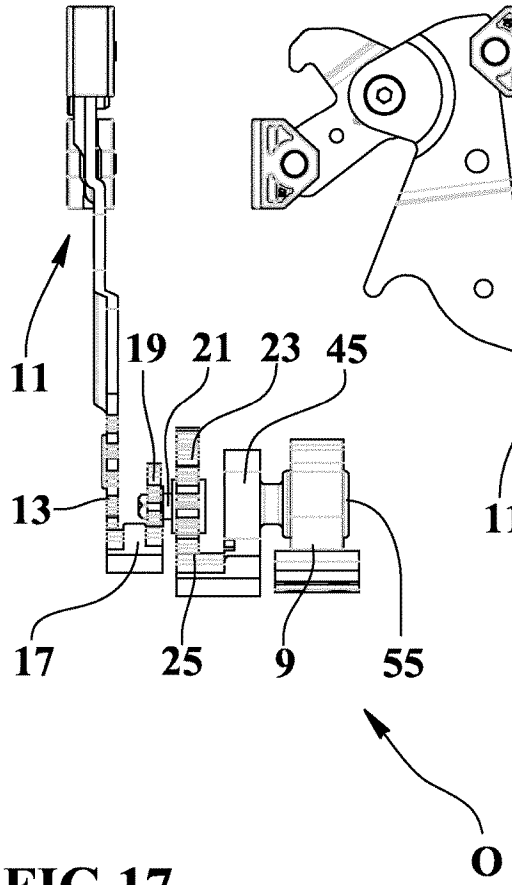
Figure 18:
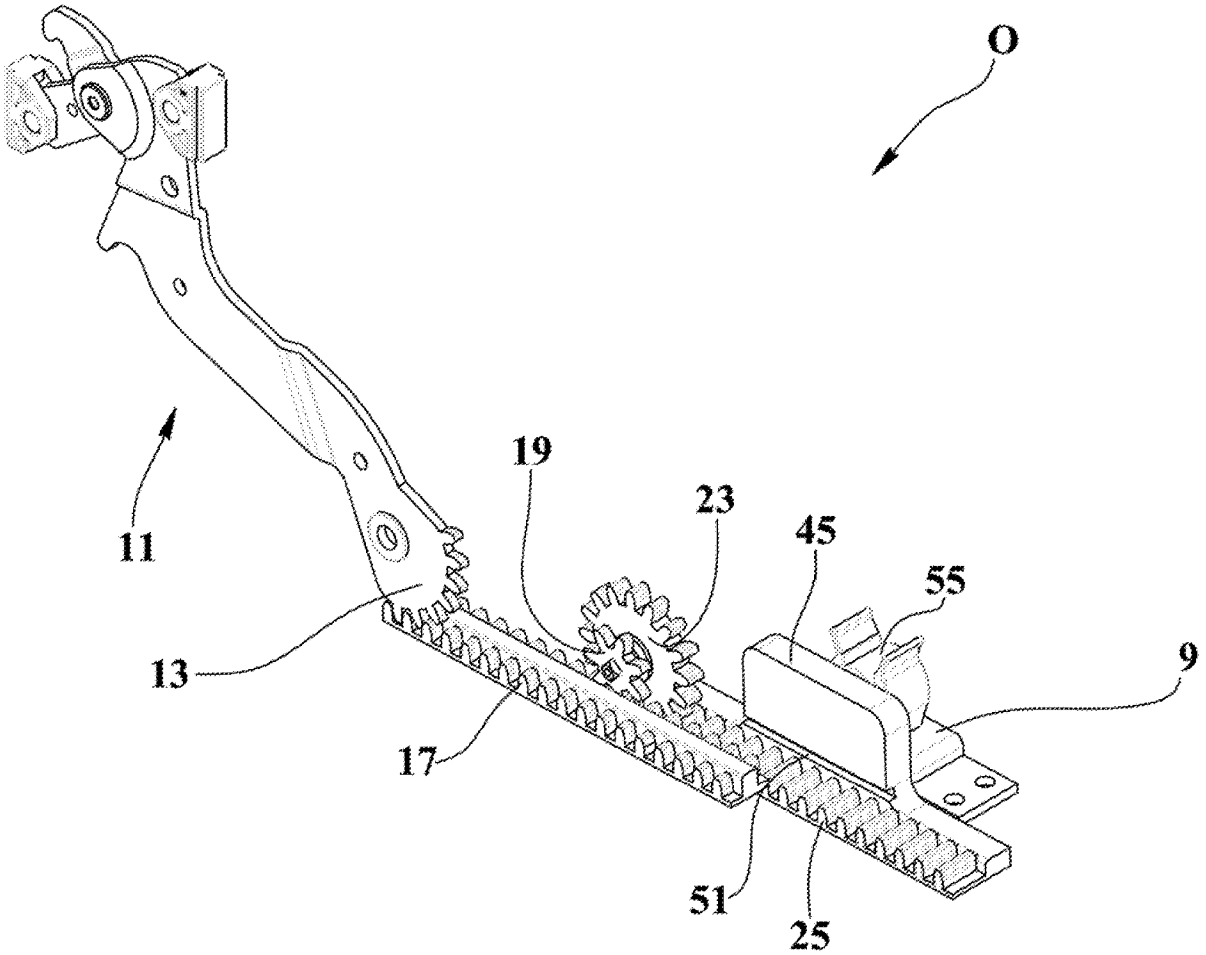

With reference to FIGS. 1-18, numeral 1 indicates the hinge device with long reciprocating stroke of a front panel P, object of the present invention, and having a first member 3 assigned to be fixed to an appliance A body and a second member 5 assigned to be fixed to a door D of the appliance A.

The first 3 and second 5 members are mutually hinged by a hinge pin 7 allowing the mutual rotation between the extreme closing C and opening O conditions of the door D of the appliance A. The hinge pin 7 is housed in seats formed or fixed in the first 3 and second 5 members.

The device 1 is also provided with a connection means 9 assigned to be fixed to the front panel P to set in action, the translation on their own geometrical plane parallel to the door D during the rotation of the latter between its extreme closing C and opening O conditions.

Said device 1 comprises a kinematic means 11 having a movable end into the first member 3 and the opposite end provided with a ring near 13 rotatable and centrally pivoted to the second member 5 or to an element fixed to the latter 5, by means of a respective first pivot pin 15 parallel to the hinge pin 7.

Said ring gear 13 consists preferably in a cogwheel sector in which case the number of its teeth is that of the entire cogwheel or ring gear and is geared with a first rack 17. The angle of the cogwheel sector of the ring gear 13 is such that the crown is always neared with the first rack 17 in all rotation conditions of the door D.

The first rack 17 is engaged by a pinion 19 mounted at one end of a second rotation pin 21 whose axis of rotation is parallel to the hinge pin 7 and is fixed with respect to the second member 5; for example, the rotation seat of the median portion of the second rotation pin 21 may be made in or fixed to the second member 5.

The end of the second rotation pin 21 opposed to the pinion 19 bears a toothed wheel 23 geared with a second rack 25 parallel to the first rack and sliding parallel to the front panel P.

The second rack 25 is connected to the front panel P by means of said connection means 9.

The relationship between rotation angle of the door D and the length of the translation of the front panel P also depends on the ratio of the operating radius of the pinion 19 and of the toothed wheel 23.

The kinematic means 11 consists of a shaped arm whose movable end into the first member 3 is connected to a spring means 27, for example consisting of a helical spring having a spring guide that allows operation in compression, which applies to said arm an elastic force agent in the direction of the closing condition C and assigned to balance, at least partially, the weight of the door D and of the panel.

The spring means 27 is connected to the movable end in the first member 3 of the arm of the kinematic means 11 by a rocker arm means 29 having one hook-shaped end connected to the free end of the spring guide.

The rocker arm means 29 is centrally pivoted in a rotatable manner to said end of the arm of the kinematic means 11.

The end of the rocker arm means 29 opposite to the end thereof connected to the spring guide of the spring means, carries a transverse pin for the connection to a rust friction pad 31 sliding with friction along a first wall of friction 33 of the first member 3.

The movable end into the first member 3 of the arm of the kinematic means 11 or the end of the latter 11 opposite to the ring gear is transversely enlarged, by way of hammer head, and the pin of the rocker arm means 29 is placed to one side of such a transversal enlargement, the opposite side of the latter enlargement carries a connection pin to a second friction pad 35 sliding with friction along a second wall of friction 37 of the first member 3 and parallel to the first wall of friction 33.

As seen, the hinge pin 7, the first pivot pin 15 and the second rotation pin 21 are parallel.

The first rack 17 slides in a respective seat 39 formed in or secured to the second member 5 and perpendicular to said pins 7, 15, 21.

The second rack 25 runs parallel to the first rack 17 and to the plane defined by the panel P and of the sliding of the latter.

The first rack 17 comprises two longitudinal toothed sectors first 41 and second 43 of equal length and separated by a longitudinal rib.

The first longitudinal sector 41 is engaged to the ring gear 13 while the second longitudinal toothed sector 43 is engaged to the pinion 19. In this way, the ring gear 13 and the pinion 19 have the same peripheral speed but may have different angular speeds determined by the respective operating radius.

The second rack 25, placed in translational motion by the toothed wheel 23, is equipped with a bracket means 45 protruding and sliding M a respective seat 47 formed in the second member 5 or fixed to it.

The seat 47 for the bracket means and the bracket means 45 are respectively provided with a rail 49 parallel to the first rack 17 and with a sliding means 51, consisting of a groove, sliding along the rail 49.

Obviously the same constraint of sliding parallel to the first rack 17 can be obtained by other means or by exchanging the position of the rail means and of the groove.

The seat 47 for the bracket mean 45 is provided with a lateral elongated slot shaped window 53 parallel to the first rack 17 assigned to the passage and to the sliding of a first fixing means 55 of the bracket means 45. The first fixing or fastening means 55 may consist of a cylindrical member laterally projecting to the bracket means 45 and externally to this seat 47 and assigned to the fixing of a second fixing or fastening means 57, for example in the form of "omega" and flexible, of the connection means 9. Such configuration of the first 55 and second 57 fastening means during installation facilitates and speeds up the application of the panel that can occur without the use of any tool.

The teeth of the racks 17, 25, of the ring gear 13, of the pinion 19 and of the toothed wheel 23 are equal and with equal step; therefore, the relationship between angle of rotation of the door D and the length of the translation of the front panel P is determined by the number of teeth of the toothed wheels 23 and the ratio of the numbers of teeth on the pinion 19 and of the toothed wheel 23. It should be noted that the invention allows to easily obtain and to overcome panel translations of about 9-10 cm, or more, with swing maximum angles of the door between the extreme closing and opening conditions lower than 90°.

Alternatively, the invention provides that the step of the teeth of the various toothed elements can be various and different, for example the teeth of the first longitudinal sector 41 of the first rack 17 are different from those of the second sector 43, in particular the second sector 43 can have a step shorter than the step of the first 41 sector and equal to that of the pinion 19 while the step, greater, of the first sector 41 is equal to that of the ring gear 13. The toothed wheel 23 and the second rack 25 may have teeth with different step yet, for example, conformed to the diameter of the toothed wheel 23, according to the standards. This makes it possible to determine the transmission ratio using exclusively or almost exclusively standard or commercial elements.

Preferably, the first 3 and second 5 members, the arm and, the ring gear 13 of the kinematic means 11 are made of punched, sheared, bended sheet, the racks 17, 25, the pinion 19 and the toothed wheel 23 are made in casted metal. Alternatively the invention provides to use other materials such as nylon, resins and composite materials.

The operability of the device allows, in the opening and closing phases, to avoid interference between the panel and the apparatus elements, for example consisting of a dishwasher, or of the furniture, for example a kitchen furniture, in which the device is integrated.

The invention claimed is:

1. Hinge device (1) with long reciprocating stroke of a front panel (P) and having a first member (3) configured for fixation to an appliance (A) and a second member (5) configured for fixation to a door (D) of the appliance (A) and pivoted to the first member (3) by means of a hinge pin (7), the hinge device (1) also equipped with a connection means (9) configured for fixation to the front panel (P) for actuating translation thereof along the door (D) during rotation of the door between extreme closing (C) and opening (O) conditions; wherein said hinge device (1) comprises kinematic means (11) having one end movable in the first member (3) and an opposite end provided with a ring gear (13) centrally and rotatably pivoted to the second member (5) or to an element fixed to the second member (5), by means of a respective first pivot pin (15), wherein said ring gear (13) is geared with a first rack (17) engaged by a pinion (19) having a second rotation pin (21) with an axis of rotation that is fixed with respect to the second member (5), wherein the second rotation pin (21) bears a toothed wheel (23) geared with a second rack (25) sliding parallel to the front panel (P) and connected to the front panel by means of said connection means (9); where the relationship between a rotation angle of the door (D) and a length of the translation of the front panel (P) depends on an operative radius of the ring gear (13) and on a ratio of an operative radius of the pinion (19) and an operative radius of the toothed wheel (23).

2. The hinge device according to claim 1 wherein the kinematic means (11) consists of a shaped arm whose end movable in the first member (3) is connected to a spring means (27) that applies an elastic force to said arm acting in a direction of the closing condition (C).

3. The hinge device according to claim 2 wherein the spring means (27) is connected to the end of the shaped arm of the kinematic means (11) movable in the first member (3) by a rocker arm means (29) centrally pivoted in a rotatable manner to said end of the shaped arm on a pivot of the rocker arm means (29) at said end of the shaped arm; one end of the rocker arm means (29) is connected to the spring means (27) and another end of the rocker arm means (29) has a first friction pad (31) sliding with friction along a first wall of friction (33) of the first member (3).

4. The hinge device according to claim 3 wherein the end of the arm of the kinematic means (11) opposite to the ring gear (13) carries a second friction pad (35) spaced from the pivot of the rocker arm means (29) for sliding with friction along a second wall of friction (37) of the first member (3) and parallel to the first wall of friction (33).

5. The hinge device according to claim 1, wherein the hinge pin (7), the first pivot pin (15) and the second pivot pin (21) are parallel; the first rack (17) slides in a respective seat (39) of the second member (5) that (39) is perpendicular to said pins (7, 15, 21) and the second rack (25) slides parallel to the first rack (17) and to the plane defined by the panel (P) and on which slides the latter.

6. The hinge device according to claim 1, wherein the first rack (17) comprises a first longitudinal toothed sector (41) and a second longitudinal toothed sector (43) separated by an intermediate longitudinal rib; wherein the first longitudinal toothed sector (41) is geared with to the ring gear (13), and the second longitudinal toothed sector (43) is geared with the pinion (19).

7. The hinge device according to claim 1, wherein the second rack (25) is equipped with a protruding bracket mean (45) sliding in a respective seat (47) carried out in, or fixed to, the second member (5); wherein the bracket mean (45) and the respective seat (47) are respectively equipped with a rail (49) and with a sliding means (51) sliding along the rail (49) parallel to the first rack (17).

8. The hinge device according to claim 7 wherein the seat (47) for at least the bracket means (45) is provided with a slot window (53) parallel to the first rack (17) and configured for the passage of a first fastening means (55) of the bracket mean (45) protruding through the slot window (53) externally to said seat (47) and assigned to fix a second fastening means (57) of the connection means (9).

9. The hinge device according to claim 1, wherein teeth of the first rack (17), teeth of the second rack (25), teeth of the ring gear (13), teeth of the pinion (19) and teeth of the toothed wheel (23) are of equal step and that a relationship between a rotation angle of the door (D) and a length of the translation of the front panel (P) is determined by a ratio of numbers of teeth of the pinion (19) and of the toothed wheel (23).

10. The hinge device according to claim 2, wherein the first (3) and second (5) members, the shaped arm and the ring gear (13) of the kinematic means (11) are made of die cut, punched and bent sheet, the first rack (17), the second rack (25), the pinion (19) and the toothed wheel (23) are made of cast metal.

* * * * *